US008122531B2

(12) United States Patent
Li

(10) Patent No.: US 8,122,531 B2
(45) Date of Patent: Feb. 28, 2012

(54) SHOWER CURTAIN ASSEMBLY

(76) Inventor: Wayne Wenchuan Li, Chadds Ford, PA (US)

( * ) Notice: Subject to any disclaimer, the term of this patent is extended or adjusted under 35 U.S.C. 154(b) by 1201 days.

(21) Appl. No.: 11/754,292

(22) Filed: May 27, 2007

(65) Prior Publication Data

US 2008/0289095 A1 Nov. 27, 2008

(51) Int. Cl.
*A47K 3/32* (2006.01)

(52) U.S. Cl. ..... 4/610; 4/608; 4/609; 4/558; 4/557; 160/349.1

(58) Field of Classification Search ..... 4/611, 558, 4/557, 609, 610; 134/349.1, 349.2, 330, 134/DIG. 6, 332; 160/349.1, 349.2, 330, 160/DIG. 6, 332
See application file for complete search history.

(56) References Cited

U.S. PATENT DOCUMENTS 3,418,665 A * 12/1968 Long ..... 4/610
2005/0268394 A1 * 12/2005 Monk et al. ..... 4/558

* cited by examiner

*Primary Examiner* — Gregory Huson
*Assistant Examiner* — Lauren Heitzer

(57) ABSTRACT

A shower curtain assembly is designed to provide users with an apparatus that provides much wide shower space for consumers than traditional one, prevents the curtain from moving inward, eliminate water spilling onto the floor, and even allows the user to sit on a top periphery of a bathtub near the curtain when the shower is in use. It is simply comprised of a shower curtain support rod that bows outward from a shower enclosure along its length, a shower curtain, hooks, and means that secures the shower curtain to achieve the above-mentioned goal. The means includes main weights attached to the lower portion of the curtain, wires connected to the lower portion of the curtain and holders fixed to the bottom edges of the sidewalls of the shower enclosure, and wires with magnets attached. Only one of them needs to be chosen for the shower enclosure for the aforementioned functions.

3 Claims, 9 Drawing Sheets

SHOWER CURTAIN ASSEMBLY

BACKGROUND OF THE INVENTION

1. Field of the Invention

The present invention relates generally to an apparatus for holding a shower curtain in such a particular way that the shower enclosure can be enlarged significantly, the shower curtain can be prevented from moving inward, water can be prevented from spilling onto the floor, and a consumer can even sit on a bathtub upper periphery near the curtain.

2. Background of the Prior Art

Shower curtains are utilized when shower is in use for a large number of shower facilities to prevent water from spraying out into a bathroom even if glass shower doors are also used. However, for the shower curtains, there is something inconvenient to a consumer. Generally, the space of a shower closure is narrow, especially for two people due to its inherent structure. The shower curtain is often drawn into the shower enclosure when the shower is in use because of a partial vacuum created by a water spray within the shower enclosure, which makes the space further smaller and causes an even inconvenient situation to the user. For a shower facility with a traditional shower curtain, the water may spill onto the floor through the gaps between vertical edges of the shower curtain and sidewalls when one is taking shower, and the user cannot sit on a top periphery of a bathtub when one wants to. In order to solve all the problems, a new shower curtain assembly needs to be investigated. As a result, that is invented as described below.

SUMMARY OF THE INVENTION

The purpose of the present invention is to make a user-friendly shower curtain system for a bathtub with a shower, a shower stall and the like, that provides much wide shower space for consumers than traditional one, prevents the curtain from moving inward, eliminate water spilling onto the floor, and even allows the user to sit on a top periphery of a bathtub near the curtain when the shower is in use.

The shower curtain assembly of the present invention is shown in design drawings. It is comprised of a substantially bow-shaped shower curtain support rod, a curtain that is suspended from the curved rod, hooks that connect the curtain to the support rod, and means that secures the main portion of the curtain is positioned away from a shower enclosure, prevent the curtain from moving inward when the shower is in use, and make vertical walls of the curtain close to opposite sidewalls of the shower enclosure. The means includes:

1. Main weights that are attached to a lower portion of an originally flat curtain to make sure that the curtain is curved following the same shape as the curtain support rod;
2. Two curved metal wires that are attached to a lower portion of an originally curved curtain, and holders fixed to sidewalls of the shower enclosure. The wires can snap to the holder to form a fixed shape of the shower curtain (called wire-holder structure in this invention);
3. A variation of the second means, two curved wires with magnets attached on their lower ends that are used to replace the wire-holder structure described in the second means (called wire-magnet structure in this invention).

For the first means, the small weight with much less mass than the main weights may be added to prevent the bottom edge of the shower curtain from moving outward during the process of opening the curtain.

For the shower curtain assembly with the weight attached, a user can close and open the curtain as a traditional one. When the curtain is closed, the weight will force the curtain to follow the shape of a rod from which the curtain is suspended. As a result, the curtain will be kept away from the shower enclosure due to the shape of the support rod that bows outward from the shower enclosure along the length of the rod, and the vertical edges of the curtain are made close to the sidewalls of the shower enclosure because both end hooks on the support rod are close to the sidewalls, which prevent shower water from splashing onto the bathroom floor. The main weight and curved shape of the curtain will prevent the curtain from moving inward when the shower is in use. A user can even sit on the top periphery of a bathtub.

Another way is to use two curved wires attached to lower portion of a shorter curtain than the above-mentioned curtain, and two holders fixed to the bottom edges of the sidewalls. When the curtain is closed, the lower portions of the wires are snapped onto the holders to ensure the curtain shape is fixed. All the aforementioned advantages are still kept.

A variation of the wire-holder structure is to use a magnet to replace the holder. The magnet are attached to the lower end of curved wire whose upper portion has the same shape as the wire-holder structure, and can be easily placed on and removed from the top periphery of the bathtub or a steel plate attached to shower stall base. The wire-magnet structure has the same function as the wire-holder one and is more flexible.

DESCRIPTION OF THE PREFERRED EMBODIMENT

Figure 1:
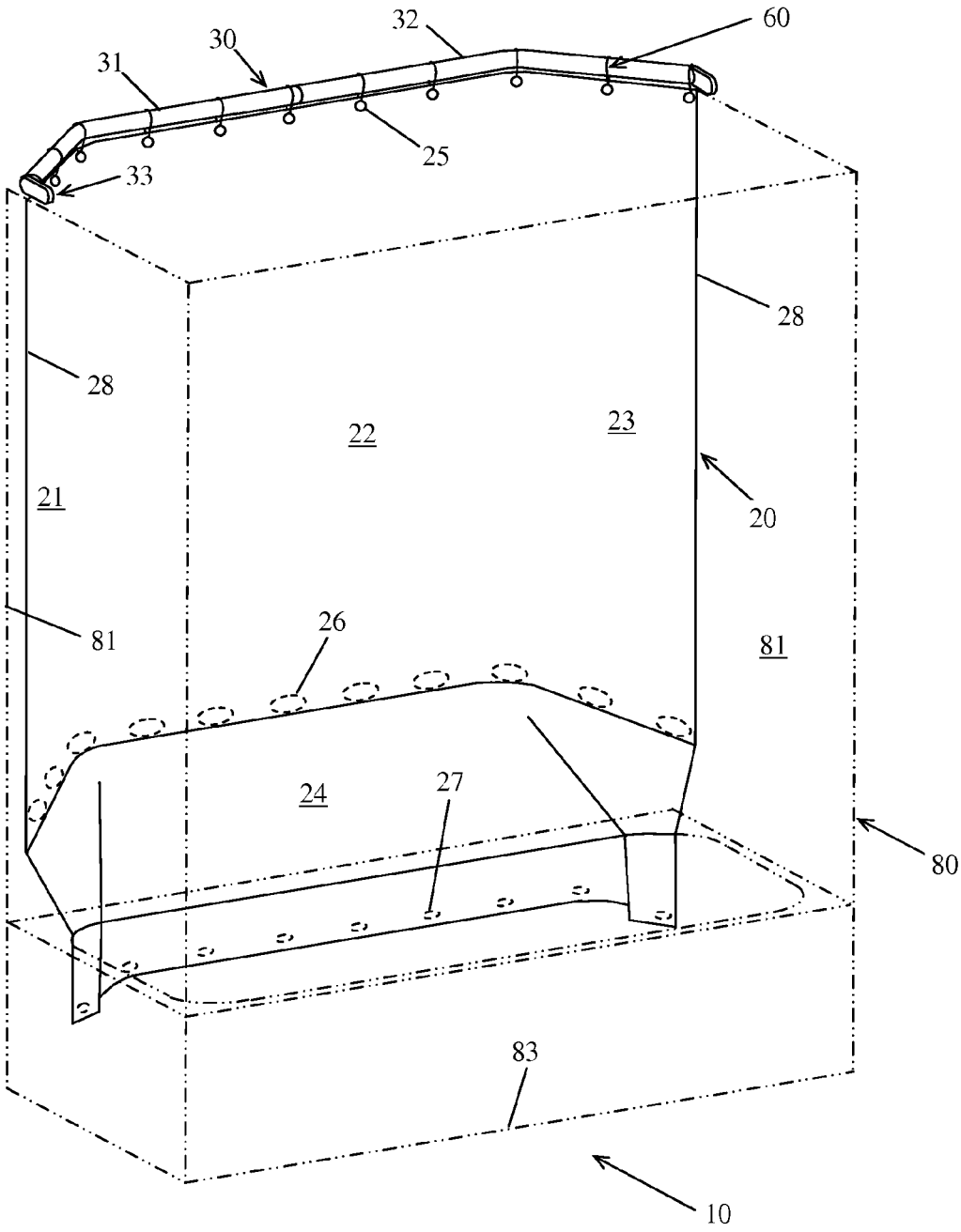
FIG. 1 is a perspective view of a shower curtain assembly with weights.
Figure 2:
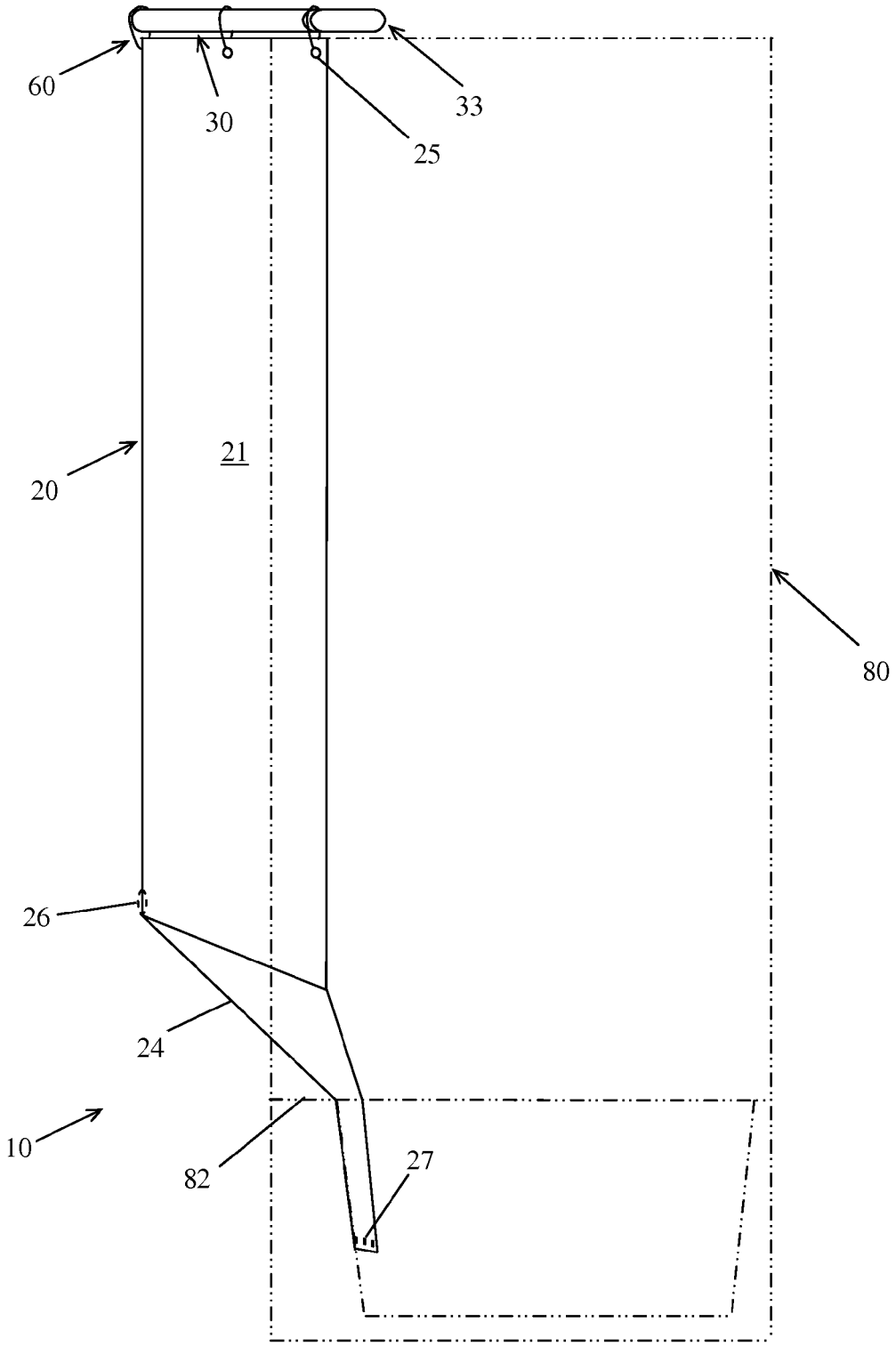
FIG. 2 is a side view of the shower curtain assembly.
Figure 3:
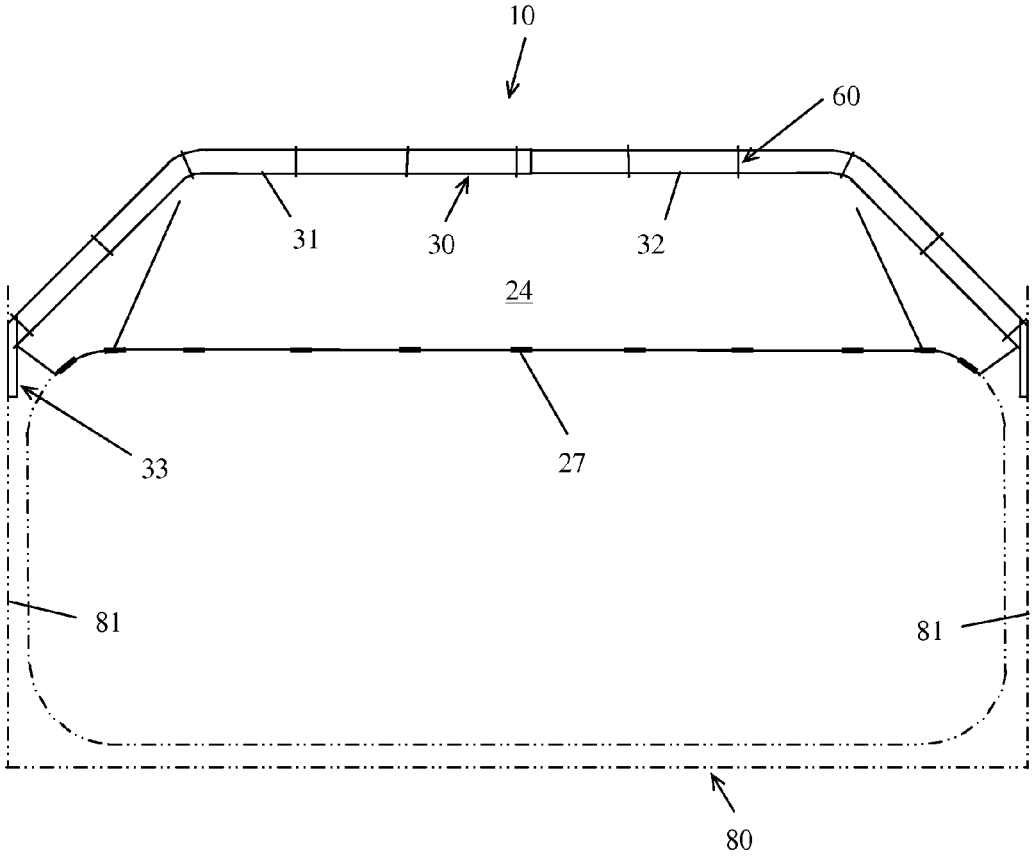
FIG. 3 is a top view of the shower curtain assembly.
Figure 4:
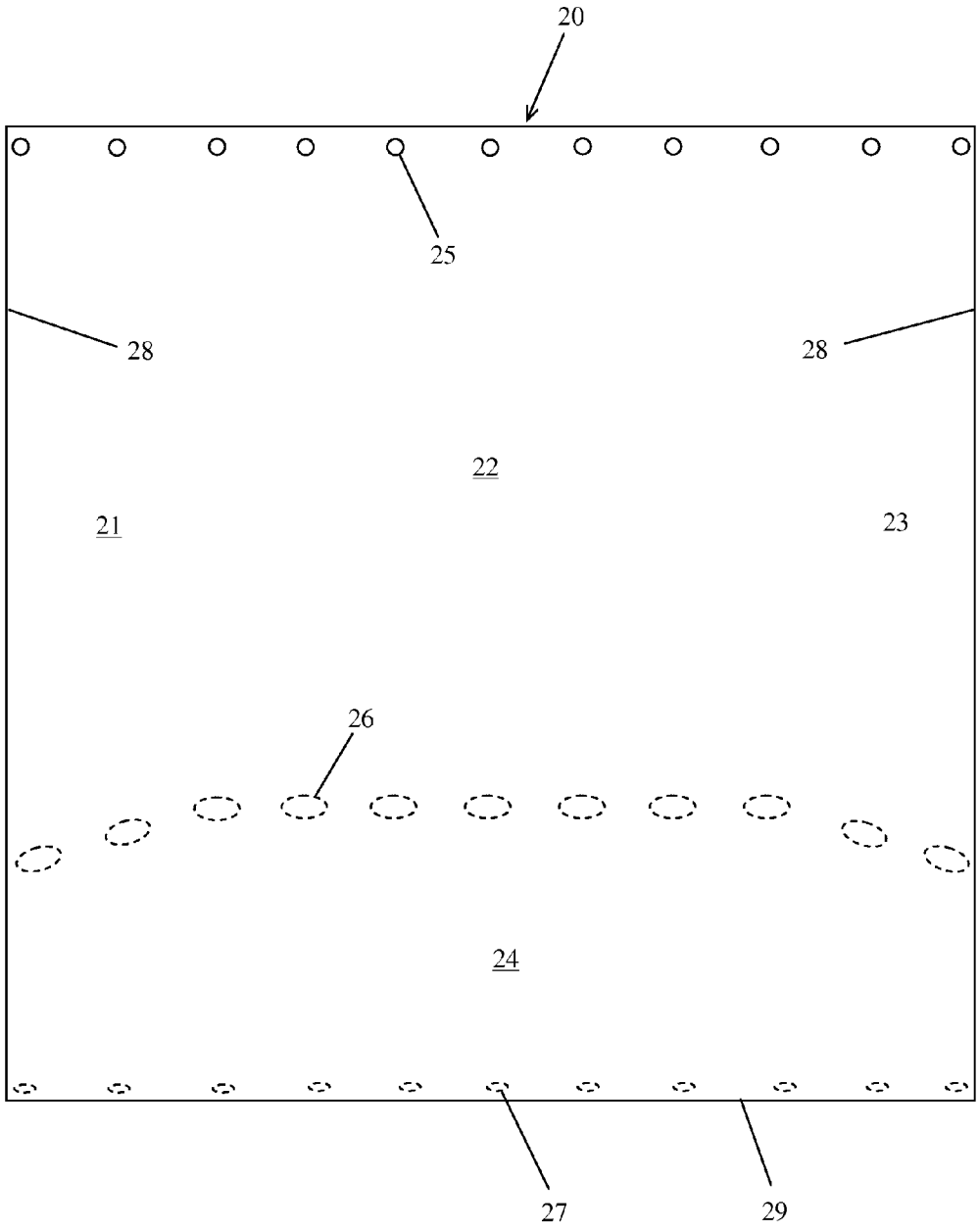
FIG. 4 is a front view of a shower curtain with weights.
Figure 5:
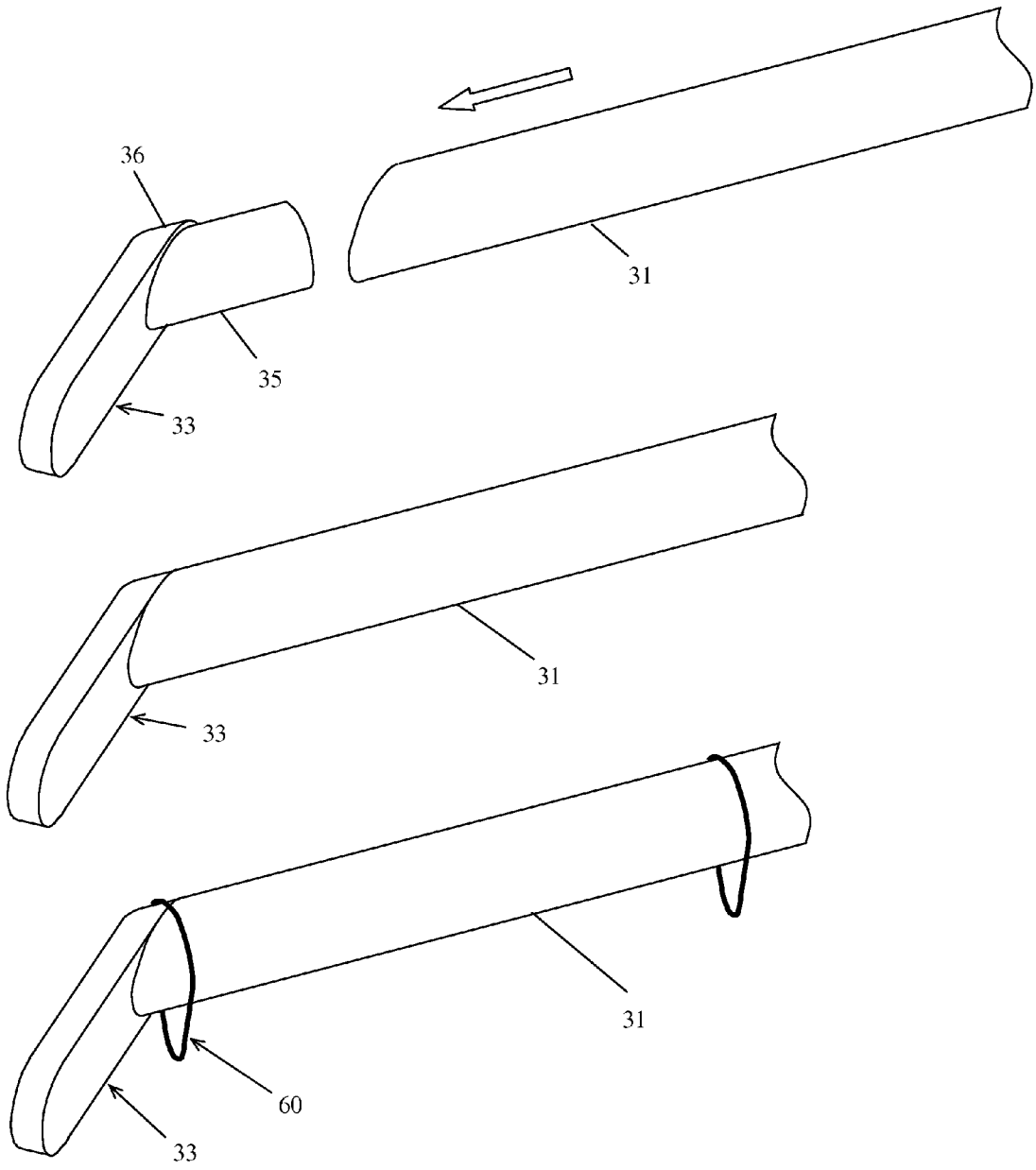
FIG. 5 is a perspective view of an end fixture of a support rod of the shower curtain assembly.
Figure 6:
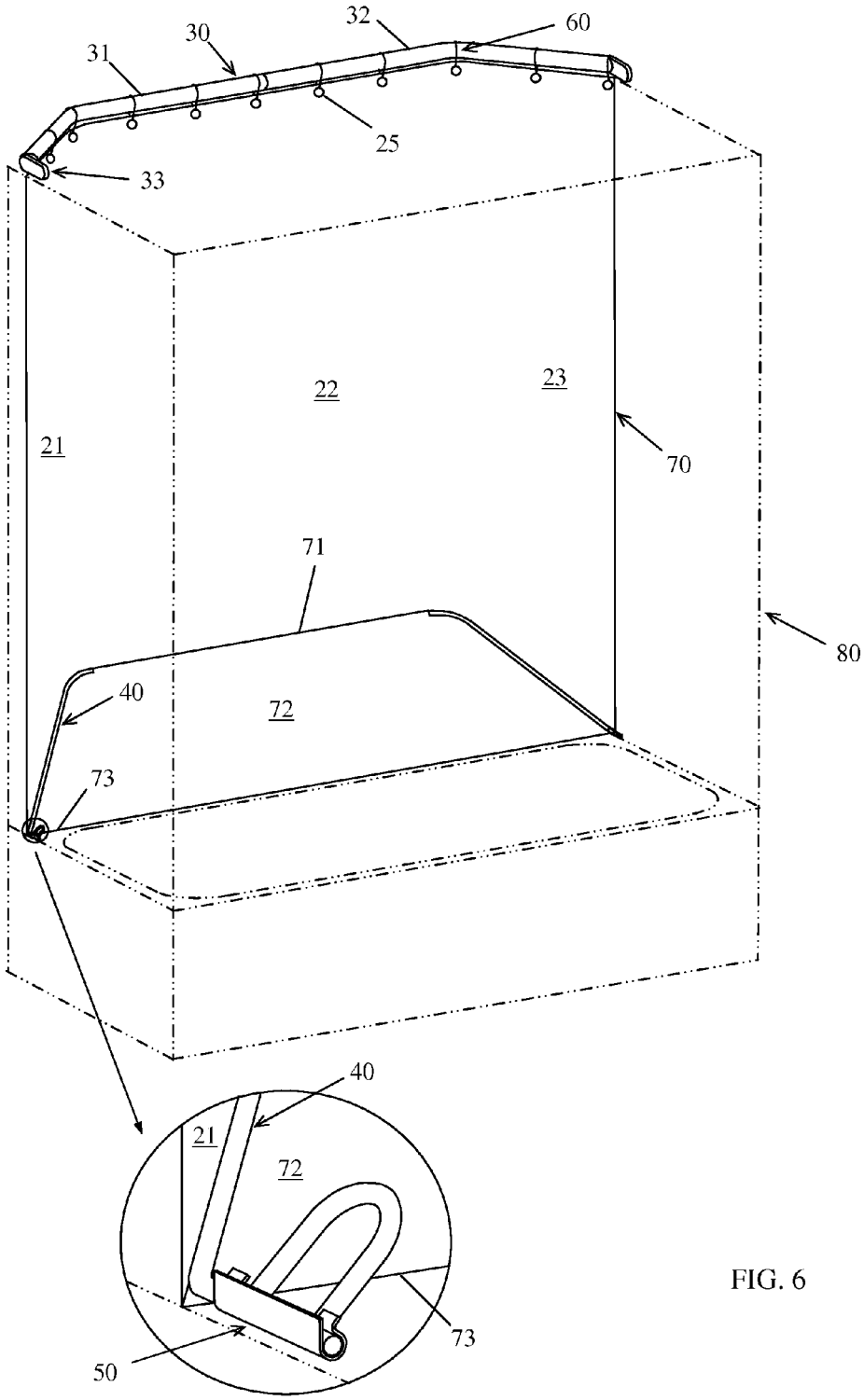
FIG. 6 is a perspective view of a shower curtain assembly with wire-holder structure.
Figure 7:
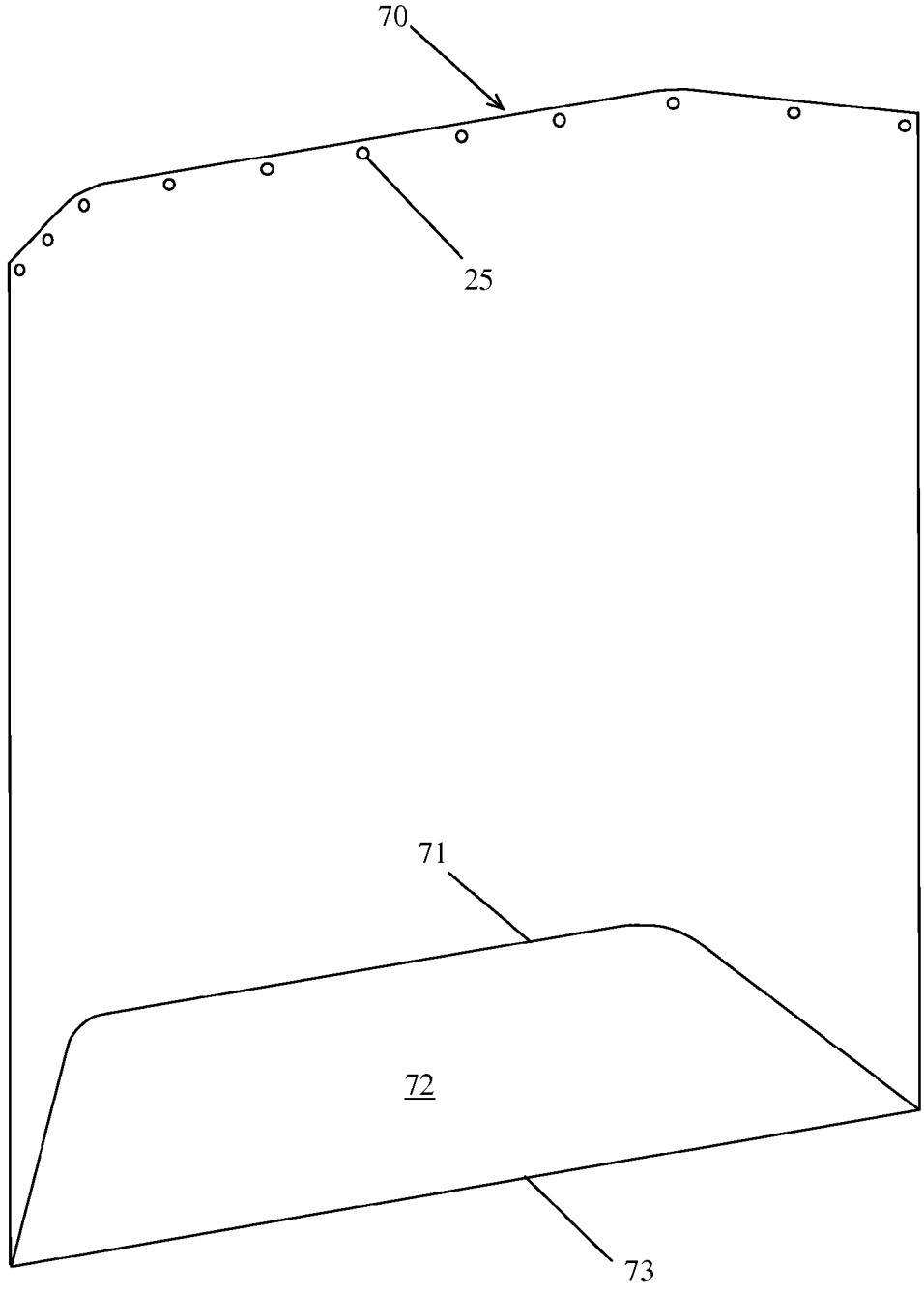
FIG. 7 is a perspective view of a shower curtain for the shower curtain assembly with wire-holder structure.
Figure 8:
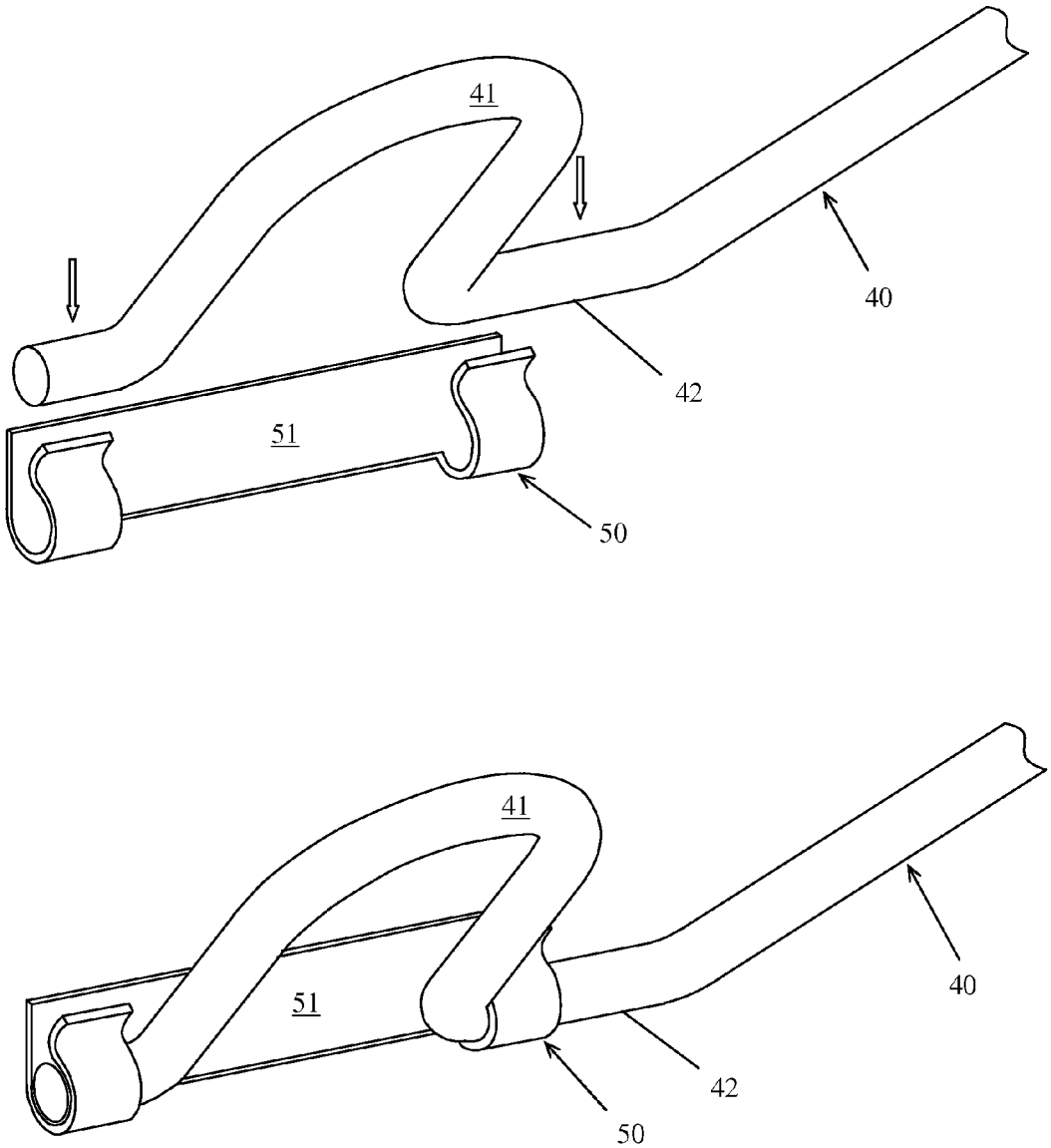
FIG. 8 is a perspective view of the wire-holder structure.
Figure 9:
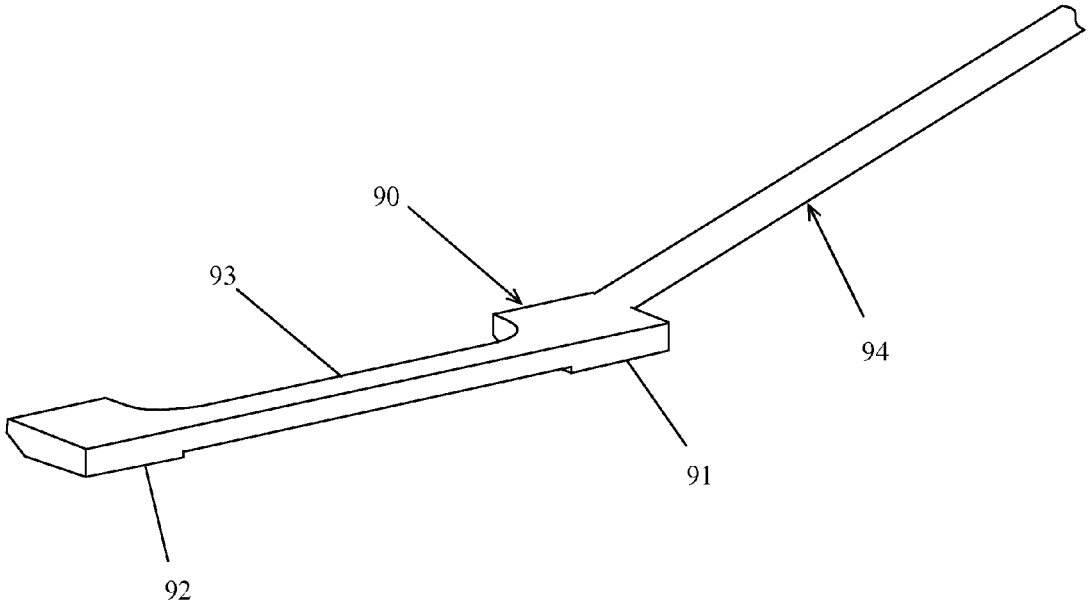
FIG. 9 is a perspective view of a wire-magnet structure.

A shower enclosure 80 is a box-like configuration and has an upper periphery, a showerhead, a base at lower periphery, an open area, and sidewalls. The shower enclosure includes a bathtub equipped with a shower, a shower stall and the like.

The shower curtain assembly 10 of the present invention is comprised of a substantially bow-shaped shower curtain support rod 30, a curtain 20/70 that is suspended from the curved rod 30, hooks 60 that connect the curtain 20/70 to the support rod 30, and means that secures the main portion of the curtain 20/70 is positioned away from a shower enclosure 80, prevent the curtain 20/70 from moving inward when the shower is in use, and make vertical edges 28 of the curtain 20/70 close to opposite sidewalls 81 of the shower enclosure 80. The means includes:

1. Main weights 26 that are attached to a lower portion of an originally flat curtain 20 to make sure that the curtain 20 is curved following the same shape as the curtain support rod 30;
2. Two curved metal wires 40 that are attached to a lower portion of an originally curved curtain 70, and holders 50 fixed to sidewalls of the shower enclosure 80. The wires 40 can be snapped onto the holders 50 to form a fixed shape of the shower curtain 70;

3. A variation of the second means, two curved wires 94 with magnets 90 attached on their lower ends that are used to replace the wire-holder structure described in the second means.

Only one of them needs to be chosen for the shower enclosure for the aforementioned functions.

The support rod 30 has a pair of end brackets 33, adopted for attachment to opposite sidewalls 81 of the shower enclosure 80, connected with a curving middle portion which is comprised of two curved metallic tubes 31 and 32 so that the two tubes 31 and 32 can relatively move to accommodate different distances between the sidewalls 81 of different shower enclosures 80. The front face 36 of the bracket 33 is designed by extending the connected tube surface so that the hook 60 can touch the sidewall 81 to make the vertical edge 28 of the curtain 20/70 close to the sidewall 81 by the gravity of the main weight 26. The portion 35 of the bracket 33 can be slid into end portion of the tube 31/32 and be fixed by screws etc. When the bracket 33 is made of steel, it can be welded to end of the tube 31/32 and the portion 35 of the bracket 33 can be made shorter or even removed.

For the shower curtain assembly with the main weight attached (first means), an original flat curtain 20 is utilized. And the small weights 27 with much less mass than the main weights 26 may be added to prevent the bottom edge 29 of the shower curtain 20 from moving outward (passing through the top periphery 82 of the bathtub or a raised lip of the shower stall along the floor) during the process of opening the curtain 20. A user can close and open the curtain 20 as a traditional one. When the curtain 20 is closed, the main weights 26 will force the curtain 20 to follow the shape of a support rod 30 from which the curtain 20 is suspended. As a result, the main portion of the curtain 20 will be kept away from the shower enclosure 80 due to the shape of the support rod 30 that bows outward from the shower enclosure 80 along the length of the rod 30. And the vertical edges 28 of the curtain 20 are made close to the sidewalls 81 of the shower enclosure 80 because both end hooks on the support rod 30 are close to the sidewalls 81, which prevents shower water from splashing onto the bathroom floor. The main weight 26 and deformed shape of the curtain 20 will prevent the curtain 20 from moving inward when the shower is in use. A user can even sit on the top periphery 82 of a bathtub.

Another way is to use a pair of curved wires 40 attached to lower portion of a shower curtain 70, and a pair of holders 50 fixed to the bottom edges of the sidewalls 81. The shape of the portion 42 of the wire 40 near the holder 50 can be adjusted according to the distance between the sidewalls 81 of the shower enclosure 80. An original curved curtain 70 is used with shorter height than the one utilized in first means. The lower portion of the curtain 70 has a bow shape similar to the support rod 30. When the curtain 70 is closed, portion of the lower ends 41 of the wires 40 is snapped onto the holders 50 to ensure the curtain shape is secured. All the aforementioned advantages for shower curtain assembly with main weights are still kept.

A variation of the wire-holder structure is to use a magnet 90 to replace the holder 50. The magnet 90 is attached to the lower end of curved wire 94 whose upper portion has the same shape as the wire 40 of the wire-holder structure, and can be easily placed on and removed from the top periphery 82 of the bathtub or a steel plate attached to the shower stall base. A user can hold the middle portion 93 to move the magnet 90. This wire-magnet structure has the same function as the wire-holder one and is more flexible.

It is to be understood that the present invention is not limited to the above-mentioned embodiments, but encompasses any and all embodiments within the following scope of the claims.

What is claimed is:

1. A shower curtain assembly for use with a shower enclosure, having an upper periphery, a showerhead, a base at lower periphery, an open area, and sidewalls, which shower enclosure includes a bathtub equipped with a shower and a shower stall, the shower curtain assembly comprising:

a shower curtain support rod positioned near said upper periphery of said shower enclosure and having a pair of end brackets, adopted for attachment to said opposite sidewalls of said shower enclosure, connected with a curving middle portion that bows outward from said shower enclosure along the length of said rod, having two curved metallic tubes and an length to accommodate different distances between said sidewalls;

a shower curtain suspended from said support rod and having an originally flat shape;

hooks connecting said shower curtain to said support rod;

main weights are attached to a lower portion of said shower curtain to make sure that said shower curtain is curved following the same shape as said support rod when said shower curtain is closed;

wherein said shower curtain can be easily closed and opened as a traditional one, when said shower curtain is closed, the main weights force said shower curtain to follow the shape of said support rod, as a result, a main portion of said shower curtain will be kept away from said shower enclosure due to the shape of said support rod, said main weights and deformed shape of said shower curtain prevent said shower curtain from moving inward when the shower is in use, and a user can even sit on the top periphery of said bathtub; and small weights with much less mass than said main weights, are attached near the bottom edge of said shower curtain to prevent said bottom edge of said shower curtain from moving outward, passing through the to periphery of said bathtub or a raised lip of said shower stall along the floor, during the process of opening said shower curtain and to ensure that said bottom edge of said shower curtain stays within said bathtub or the raised lip of said shower stall the shower is in use.

2. The shower curtain assembly of claim 1, wherein the front face of said support rod end bracket is designed by extending said connected tube surface so that said hook near the end of said support rod can touch said sidewall to make the vertical edge of said shower curtain close to said sidewall by gravity of said main weights when said main weights when said shower curtain is closed, and prevent water from spilling onto the floor.

3. The shower curtain assembly of claim 1, wherein a portion of said bracket is slid into the end portion of said tube and be fixed by screws or welded when said bracket is made of steels.

* * * * *